US006047447A

United States Patent [19]

Ueno

[11] Patent Number: 6,047,447

[45] Date of Patent: Apr. 11, 2000

[54] SEALING DEVICE

[75] Inventor: Hideyuki Ueno, Kanagawa Prefecture, Japan

[73] Assignees: Kotec's Co., Ltd, Higashi-Nippori; Snayo Seisakusho Co., Ltd., Tokyo, both of Japan

[21] Appl. No.: 09/106,079

[22] Filed: Jun. 29, 1998

[51] Int. Cl.[7] ..... B65D 63/00

[52] U.S. Cl. ..... 24/16 PB; 24/30.5 P; 24/17 AP; 292/318

[58] Field of Search ..... 24/16 R, 16 PB, 24/17 AP, 17 R, 30.5 P, 30.5 R, 573.1; 248/74.3; 292/318–322

[56] References Cited

U.S. PATENT DOCUMENTS

| | | | |
|---|---|---|---|
| 3,402,435 | 9/1968 | Merser | 24/16 PB |
| 3,588,963 | 6/1971 | Moberg | 24/16 PB |
| 3,600,027 | 8/1971 | Noland et al. | 24/16 PB X |
| 3,712,655 | 1/1973 | Fuehrer | 24/16 PB X |
| 3,816,879 | 6/1974 | Merser et al. | 24/16 PB |
| 4,093,288 | 6/1978 | Suzuki | 24/16 PB X |
| 4,240,183 | 12/1980 | Sumimoto et al. | 24/16 PB |
| 4,245,374 | 1/1981 | Suzuki | 24/16 PB |
| 4,559,676 | 12/1985 | Paradis | 24/16 PB |
| 4,588,218 | 5/1986 | Guiler et al. | 24/16 PB X |
| 4,854,014 | 8/1989 | Ueno | 24/16 PB |

*Primary Examiner*—James R. Brittain
*Assistant Examiner*—Robert J. Sandy
*Attorney, Agent, or Firm*—Pisner & Pisner

[57] ABSTRACT

The present invention is to provide a new sealing device which has not a capability of the push-through head portion being re-inserted into the socket portion 2 again after when the sealing condition has once been broken and further, a new sealing device can be provided in which an evidence showing the fact that the sealed condition of the sealing device had been broken, intentionally, is remained on this sealing device.

In the present invention, a sealing device 30 is provided which comprises a filament portion 3, a push-through head portion 19 provided at one of ends portion of the filament portion 3 and having a suitable connecting portion 23 which comprises such as, for example, a hooked portion, and a socket portion 2 provided at another end of the filament portion 3 and having a hole 10 through which the push-through head portion 19 can pass in one direction but not be withdrawn in the opposite direction, and wherein a stretch strength of the push-through head portion 19 is set at a certain level in that it is smaller than that of the filament portion 3.

8 Claims, 9 Drawing Sheets

SEALING DEVICE

DESCRIPTION OF THE INVENTION

1. Field of the Invention

This invention relates to a sealing device which can be attached to goods including clothes, shoes, bags and so on, so as to make necessary seal for those goods accompanied with a tag including branded label, price tag, explanation about materials used therefor, explanation how to use same, or the like.

This invention is especially relate to a sealing device which cannot be used again for sealing something after when it had been sealed a certain goods with certain tag through a loop-like filament formed when it is used for seal.

2. Description about the Related Art

In the past, a sealing device as shown in FIGS. 6A and 6B, has been used for sealing goods including any kinds of clothes, boots especially for women, sandals, any kinds of shoes, or the like so as to connect to each other or to attach a branded label or a price tag thereto.

As shown in FIG. 6(A), a sealing device 30 which has been used heretofore, has a construction in that which comprises a filament portion 3 which can make a loop like configuration through a tag T when it is used for sealing something, a push-through head portion 19 provided at one of ends portion of the filament portion 3 and having a hooked portion, and a socket portion 2 provided at another end of the filament portion 3 and having a hole 10 through which the push-through head portion 19 can pass.

In this past sealing device, the above-mentioned portions are preferably made of synthetic resin polymer material and preferably being integratedly molded into one piece and further, especially for the filament portion 3, it may be formed by drawing method for drawing synthetic polymer resin material so as to make this portion strong against stretching force.

FIG. 6(A) shows a condition in that the push-through head portion 19 is fixed inside the socket portion 2, and it is apparent from FIG. 6(B), when the push-through head portion 19 is completely passed through an narrowed portion of the socket portion 2, that corresponding to a projectedly formed portion 16, a hooked portion, for example, a bladed portion 23, is moved outwardly so that the push-through head portion 19 can be fixed inside the socket portion 2 no to be withdrawn to an opposite direction to a direction to which the push-through head portion 19 is inserted into the socket portion 2, and thus a necessary seal can be completed by forming a loop-like label attaching portion.

In the past, this kind of sealing device has been mainly used not only for combining a couple of boots, sandals, or shoes or the like, but also for fixedly attaching branded label, tag explaining how to use the certain goods thereto.

However, recently, very significant problems have been arisen in that this kind of sealing devices are frequently detached from the certain good, by a third person, illegally, and unlawful exchanging operations have been conducted under which correct price tags are intentionally exchanged with separate price tags different therefrom or a high quality of the branded goods are exchanged with imitation goods therefor, or genuine famous branded labels are stolen by exchanging them with separate imitation labels.

Therefore, there must be generated a situation in that reliability to consumers for these goods had been deteriorated.

For example, in a department house or supermarket, a selling section in which many goods to be soled are displayed is usually located in an area independently separated from a place in which a cashing portion is provided.

Note that in the past as explained above, since the tip end portion of the push-through head portion 19 of the sealing device or the blade portion as provided in a vicinity of the push-through head portion 19, or the projecting portion are usually formed with relatively weak, thus when a little bit higher stretching force is applied to this sealing device, the blade portion or the projecting portion will be deformed so that the push-through head portion 19 can be withdrawn from the socket portion 2 reducing the looped filament 3 into non-looped condition.

Accordingly, the labels or the price tags which are held by the looped filament portion 3 can be stolen or exchanged with separate labels or price tags different therefrom, and after that the push-through head portion 19 can be re-inserted into the socket portion 2 to re-establish the original condition from which no body knows that it is incorrect condition.

In this case, since the push-through head portion 19 is usually deformed significantly, there exist many cases in that the push-through head portion 19 cannot be re-inserted into the socket portion 2 easily but there must exist many cases in which it can be realized.

Further, in that situation, even when the push-through head portion 19 can be re-inserted into the socket portion 2, although no guarantee for the push-through head portion 19 to be fixedly held inside the socket portion 2 is available, the third party cannot accurately discriminate such incorrect condition over this sealing device from the correct condition since the incorrect sealing device is externally appeared as if it is a correct sealing device.

Accordingly, significant problems under which many genuine consumers are forced to buy goods having bad quality or imitation goods for highly qualified branded goods, have been arisen.

The reasons of the above-mentioned problems are such that in the conventional sealing device, the push-through head portion 19 is easily detachable to the socket portion 2.

Note that, as shown in FIG. 6(B), even if a good is sealed with the sealing device, when a relatively large amount of stretching force is applied to the sealing device, the hooked portion or a bladed portion 23 of the push-through head portion 19 is deformed so that the push-through head portion 19 can be released from the socket portion 2 and then the push-through head portion 19 can be re-inserted into the socked portion 2 again.

Therefore the object of the present invention is to provide a new sealing device which has not a capability of the push-through head portion being re-inserted into the socket portion 2 again with highly possibility thereof.

The another object of the present invention is to provide a new sealing device which can remain an evidence showing the fact that the sealed condition of the sealing device had been broken when some one had broken the sealing condition of the sealing device, intentionally.

SUMMARY OF THE INVENTION

In order to attain the object of the present invention as mentioned above, the present invention basically comprises the following technical constructions, such as; a sealing device which comprises a filament portion, a push-through head portion provided at one of ends portion of the filament portion and having a suitable connecting portion having a root portion, and a socket portion provided at another end of the filament portion and having a hole through which the push-through head portion can pass in one direction but not be withdrawn in the opposite direction, and wherein a stretch strength of the push-through head portion is set at a certain level in that it is smaller than that of the filament portion.

And more specifically, the sealing device of the present invention comprises a filament portion, a push-through head portion provided at one of end portions of the filament portion and having a hooked portion, and a socket portion provided at another ends of the filament portion and having a hole through which the push-through head portion can pass in one direction but not be withdrawn in the opposite direction, and wherein the sealing device being constructed so that once when the push-through head portion had been inserted into the socket portion to seal, a predetermined portion of the push-through head portion is cut off with stretch force so as to be prevented the sealing device from being re-sealed.

In accordance with the technical construction as mentioned above, the object of the present invention can be realized.

Note that, specifically, the sealing device is so constructed that after when the push-through head portion had once be inserted into the socket portion so as to establish a sealed condition, and then the sealing device had been cut off at a predetermined portion with a predetermined stretching force, it is impossible for the push-through head portion to be re-inserted into the socket portion so as to re-establish the sealing condition.

DETAILED EXPLANATION OF THE PREFERRED EMBODIMENTS

Specific embodiments of the present invention will be explained hereunder with reference to the attached drawings.

Figure 1:
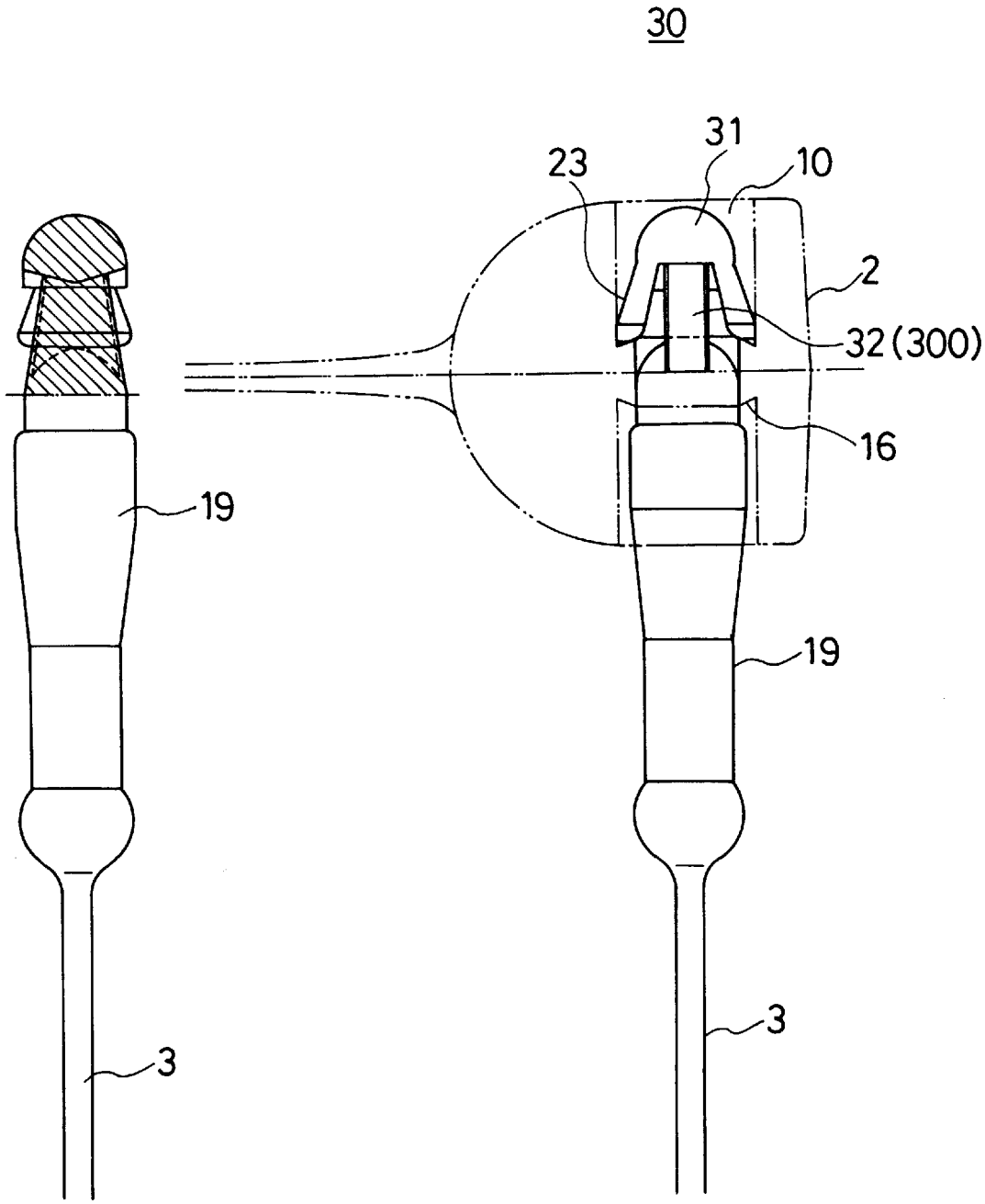
FIGS. 1A and 1B shows a first embodiment of the sealing device of the present invention.

FIG. 1 shows a first embodiment of the sealing device 30 of the present invention which comprises a filament portion 3, a push-through head portion 19 provided at one of ends portion of the filament portion 3 and having a suitable connecting portion 23 which comprises such as, for example, a hooked portion, and a socket portion 2 provided at another end of the filament portion 3 and having a hole 10 through which the push-through head portion 19 can pass in one direction but not be withdrawn in the opposite direction, and wherein a stretch strength of the push-through head portion 19 is set at a certain level in that it is smaller than that of the filament portion 3.

In the sealing device 30 of the present invention, it is preferable that a portion of the push-through head portion 19 is constructed so that it can be cut off with a certain amount of stretch force after it had been inserted into the predetermined hole 10 provided in the socket portion 2.

Normally, in the sealing device 30 of the present invention, breaking strength force to break the seal of the sealing device 30 is preferably set at relatively higher level but if the level of the breaking strength force of the filament portion 3 and the sealing device 19 are set at too high level, the filament portion 3 would be abnormally stretched leading the blade portions of the push-through head portion 19 or the projecting portion provided inside the socked portion would be deformed or destroyed so as to release the sealing condition of the sealing device 30, and further, the push-through head portion 19 can be re-inserted into the hole 10 of the socket portion 2.

Thus, too high level of breaking stretch strength thereof is not preferable and accordingly, it is desirable so that the connecting portion 23 of the push-through head portion 19 is designed to have a maximum break stretching strength within a range in which the connecting portion 23 of the push-through head portion 19 is cannot be cut off.

On the other hand, the sealing device 30 can also be used for fastening a pair of women booths, sandals or shoes, as well, and in that case, some significant load would be applied to the sealing device 30 when they are moved from one place to another place, for example.

And thus separate situation in that the sealing device 30 would be broken with relatively lower break stretching force, must be avoided.

Therefore, in the present invention, the sealing device 30 is preferably constructed so that at least a portion thereof can be cut off when it is suffered from break stretching force of 6 to 8 kg, and preferably it is set at the level of 7 to 7.5 kg.

Further in the present invention, it would be preferable that at least a portion of the push-through head portion 19 is so constructed that it can be remained inside of the socket portion 2 after when the push-through head portion 19 had been cut off.

Note that, in the present invention, since at least a portion of the push-through head portion 19 is remained in the hole 10 of the socket portion 2, it can be easily recognized that the push-through head portion 19 had been illegally broken and simultaneously with this, the rest of the portion of the push-through head portion 19 cannot be re-inserted into the socket portion any more.

In the present invention, it would be preferable that the sealing device 30 is preferably made of synthetic polymer resin and molded therefrom and then it is drawn to form a final product.

On the other hand, in it would be preferable that the push-through head portion 19 is preferably made of undrawn synthetic polymer resin so that the push-through head portion 19 made of undrawn synthetic polymer resin has break stretching strength being relatively lower than that of the filament portion 3.

Further in the present invention, the filament portion 3 of the sealing device 30 is preferably made of drawn synthetic polymer resin so that the filament portion 3 has break stretching strength being relatively higher than that of the push-through head portion 19.

Next, the first embodiment of the sealing device 30 of the present invention will be more precisely explained with reference to FIG. 1.

Figure 6:
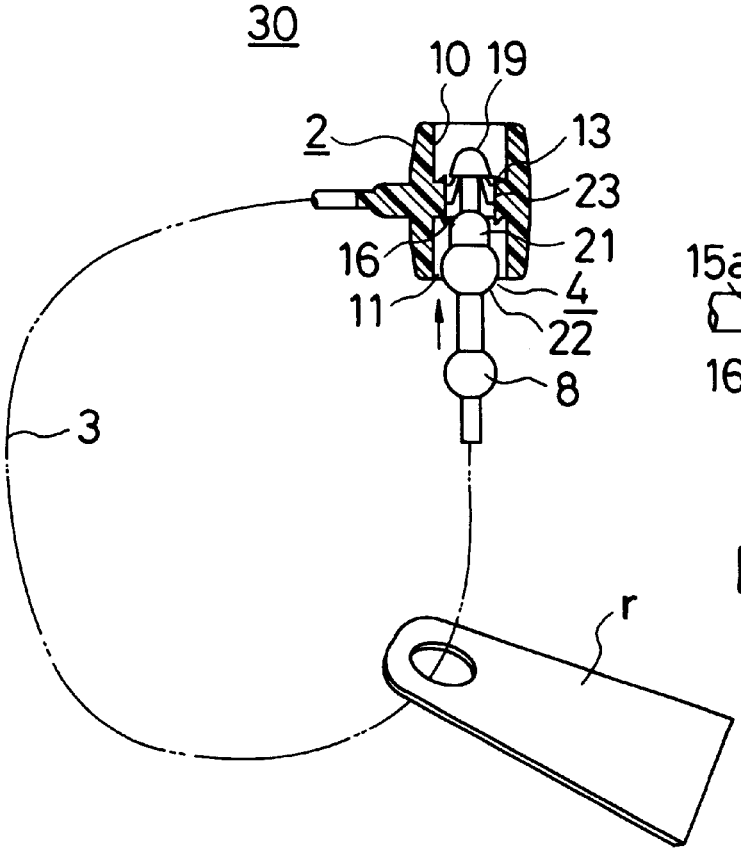
Fig.6 (A) Prior Art
FIGS. 6A and 6B shows an example of a conventional sealing device.
Figure 6:
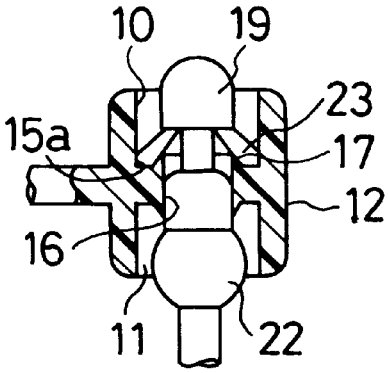
Fig. 6 (B) Prior Art

First, a basic construction of the sealing device 30 of the present invention, has a similar construction of a conventional sealing device as shown in FIG. 6. though, in the present invention, the socket portion 2 is provided with a hole 10 through which the push-through head portion 19 can pass in one direction but not be withdrawn in the opposite direction, and further a contacting portion 16 which can be connected with a bladed portion or a projecting portion 23, a part of the push-through head portion 19, is provided inside the hole 10 of the socket portion 2.

In the present invention, the contacting portion 16 comprises a projecting portion or concaved portion formed inside the hole 10.

Further in the present invention, the push-through head portion 19 of the sealing device 30 is further preferably provided with at least a projecting portion 23 fitted to the contacting portion 16 or at least one blade portion 23 having bias force directed to an external direction of the push-through head portion 19 so as to contact to the contacting portion 16.

Figure 7A:
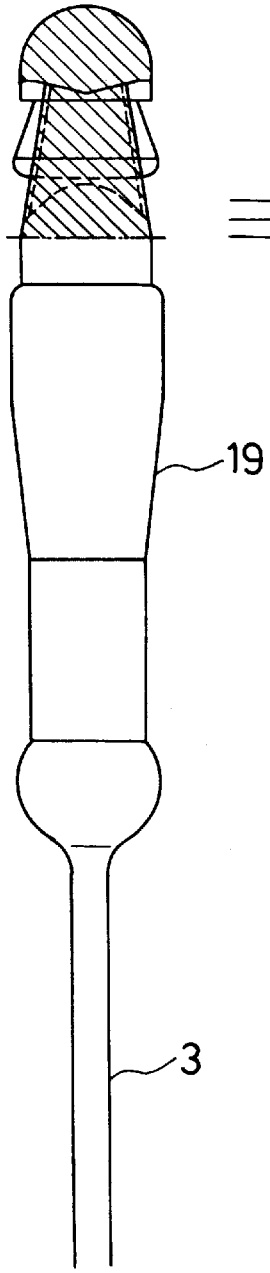
Fig. 7(A) Prior Art
FIGS. 7A and 7B shows a construction of a conventional sealing device.
Figure 7B:
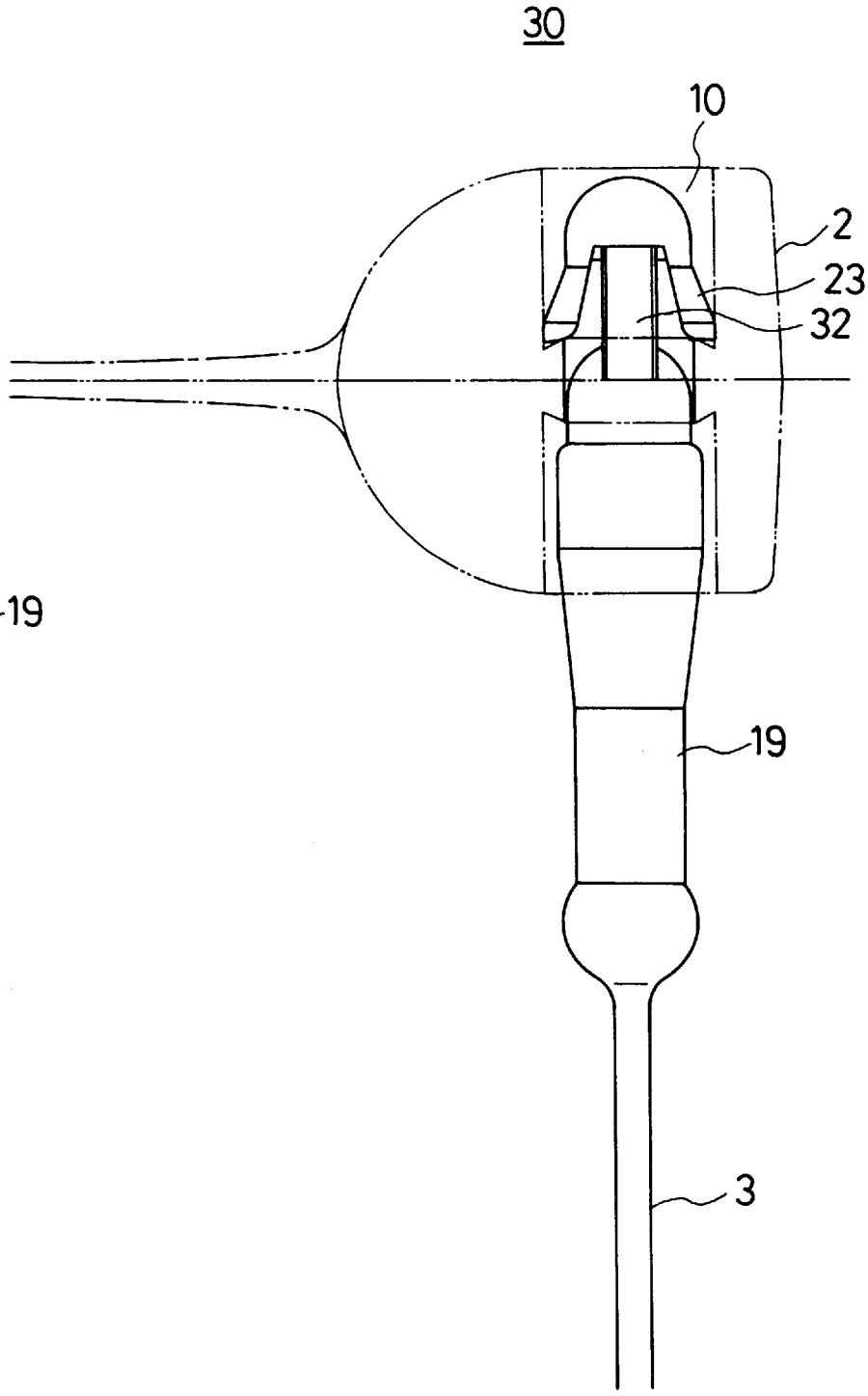
Fig. 7(B) Prior Art

Accordingly, in the first embodiment of the present invention, the strength of the bladed portion 23 including the projecting portion or the wing-like portion of the push-through head portion 19 is increased as comparing with that of the push-through head portion 19 of the conventional sealing device as shown in FIG. 7, and thus such bladed portion 23 of the present invention, cannot be deformed with the breaking stretching force of around 6 to 8 kg so that the push-through head portion 19 is intended so as not to be easily withdrawn from the socket portion 2 and therefore a part of the push-through head portion 19 can be cut off.

More specifically explained, as shown in FIG. 1(A), the above-mentioned effect can be realized, for example, by enlarging a thickness of the bladed portion 23 which connecting to the head portion 31 that is a tip end portion of the push-through head portion 19 or by enlarging a diameter or a thickness of a connecting root portion formed between the bladed portion 23 and the head portion 31.

In accordance with the reinforcement of the root portion of the contacting portion, the push-through head portion is so constructed that the push-through head portion cannot easily be withdrawn from the socket portion.

Figure 2:
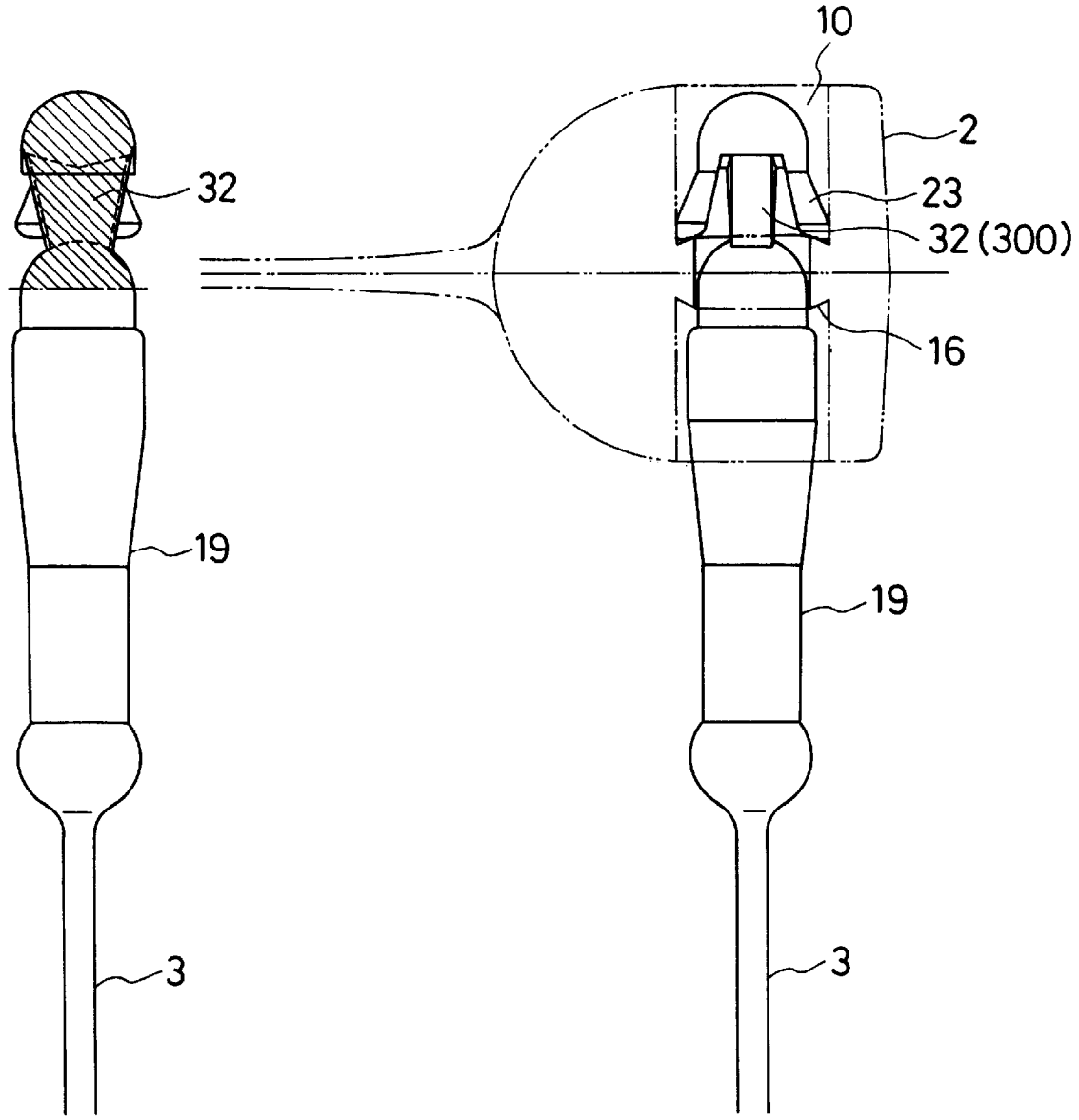
FIGS. 2A and 2B shows a second embodiment of the sealing device of the present invention.

Other embodiment of the present invention will be explained with reference to FIGS. 2 to 4, hereunder.

In the second embodiment of the present invention, at least a portion of the push-through head portion 19 is provided with a weak portion 300 which can be easily cut off with a predetermined break stretching force, and as shown in FIG. 2(A), in a specific embodiment thereof, the weak portion comprises a portion 32 provided at least on one portion of the push-through head portion 19 and having a diameter being smaller than that of the push-through head portion.

Note that as shown in FIG. 2(A), a portion 32 having a small diameter, is provided between the head portion 31 that is a tip end portion of the push-through head portion 19 and a separate undrawn portion connected thereto.

Although the construction of this embodiment is similar to that of the push-through head portion 19 of the conventional sealing device, as shown in FIG. 7, in the present invention, the diameter of the connecting portion connecting the head portion 31 to the undrawn portion is intentionally formed to have a small diameter and further, more preferably as shown in FIG. 2(B), a cross-sectional configuration of the portion having a smaller diameter 32 is varied so as to form a more weaker portion.

Figure 3:
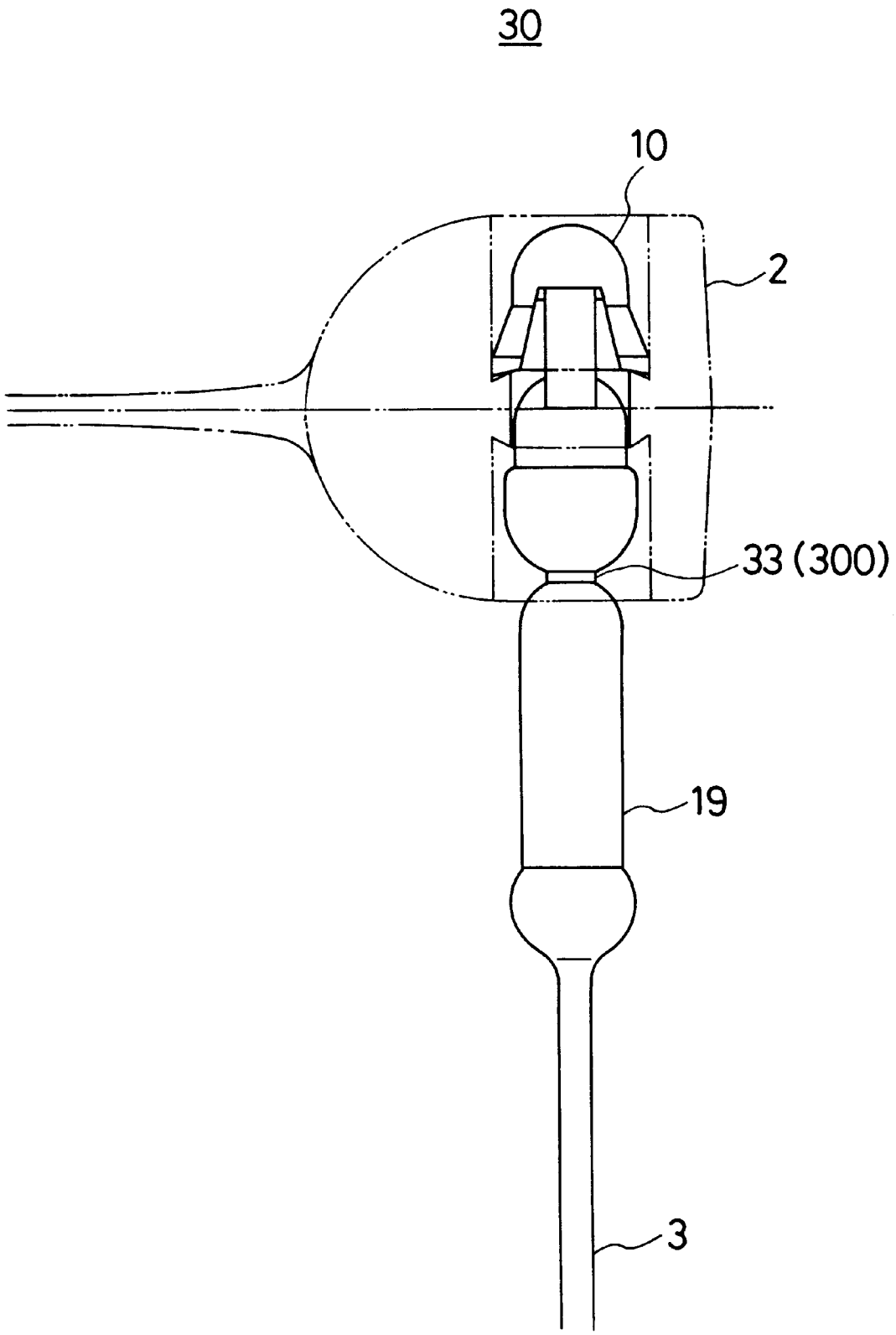
FIG. 3 shows a third embodiment of the sealing device of the present invention.

In a third embodiment of the sealing device 30 of the present invention, as shown in FIG. 3, the weak portion 300 comprises a slit portion 33 formed at least on one portion of the push-through head portion 19 and formed in a direction perpendicular to an axis of the push-through head portion 19.

In this embodiment, the slit portion 33 can be formed along a overall circumference of the push-through head portion 19 or it can be formed at least a part of the circumference thereof.

Further in this embodiment, a depth of the slit portion 33 or a space existing the adjacent slits or the number of the slits are not restricted but it can be optionally designed within an range so as to meet with the above-mentioned conditions.

Figure 4:
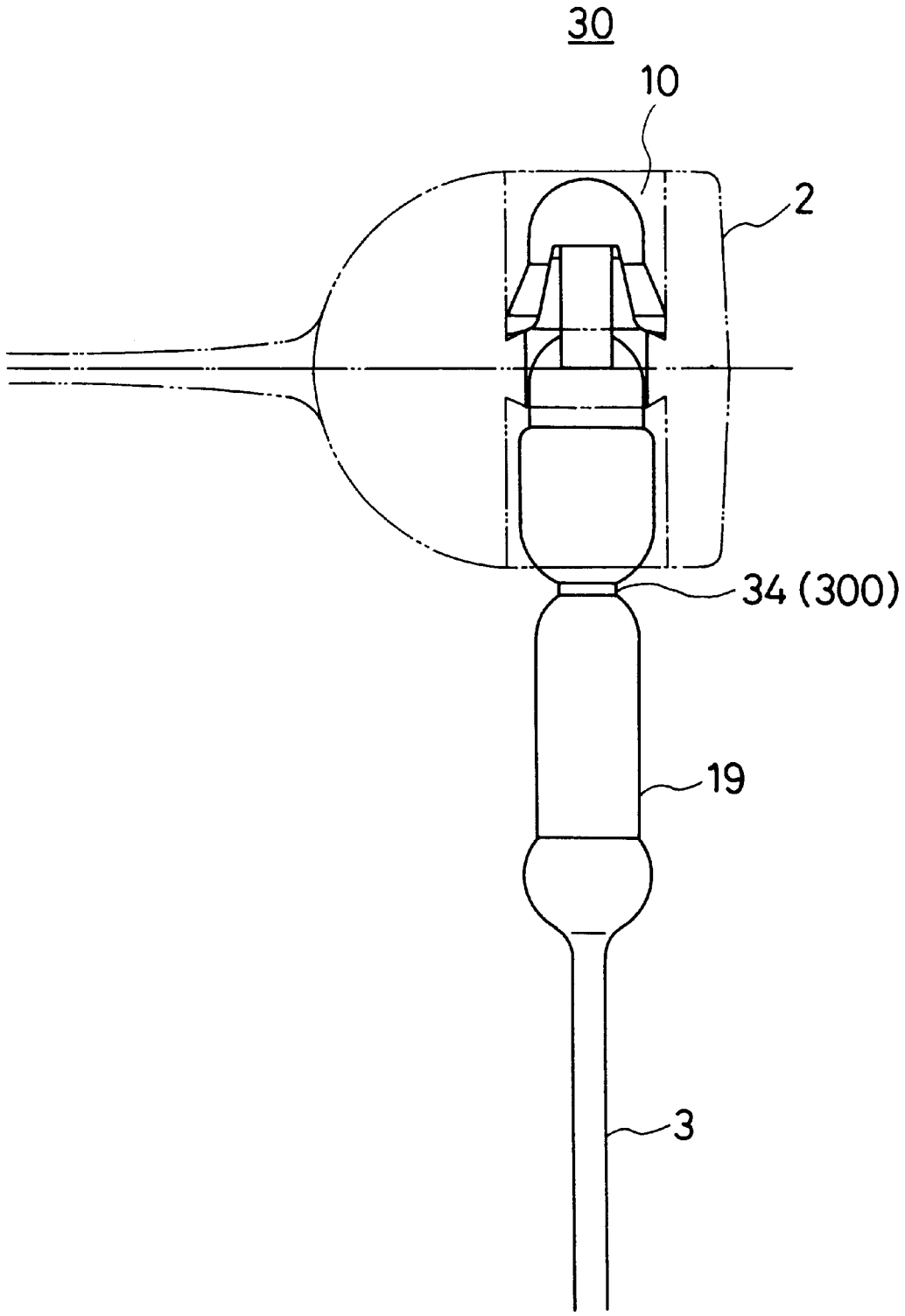
FIG. 4 shows a fourth embodiment of the sealing device of the present invenion.

In this embodiment as shown in FIG. 3, although it is shown that such a slit portion 33 is provided on a portion of the push-through head portion 19, which is inserted into the socket portion 2, in the present invention, it is not restricted to this embodiment but, for example, as shown in FIG. 4, on a portion of the push-through head portion 19, a head portion thereof inserted into the socket portion 2, a slit portion 34 may be provided.

Figure 5:
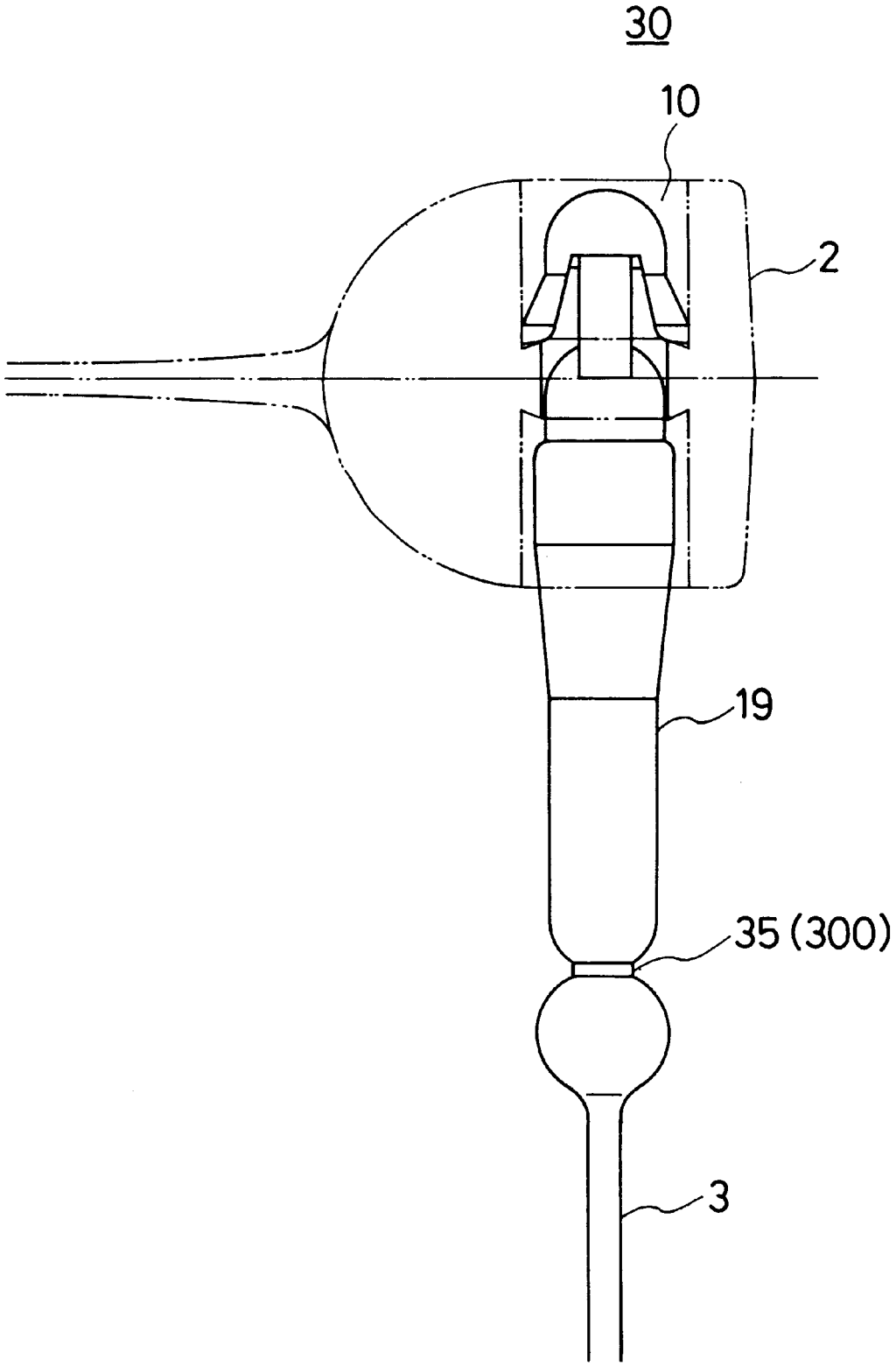
FIG. 5 shows a fifth embodiment of the sealing device of the present invention.

In another embodiment of the present invention, as shown in FIG. 5, the similar kind of the slit portion 35 to the slit portion 34, can be provided on a portion of these push-through head portion 19 which is away from the socket portion 2.

Further, in the present invention, when the slit portion or a section having a narrow diameter is provided on the push-through head portion 19 of the sealing device, the slit portion naturally becomes weak portion and thus in a case may be, it will be broken unnecessarily.

To avoid such problem, the break-strength there of should be a little bit higher than that used normally, with respect to the object of the sealing device.

Figure 8B:
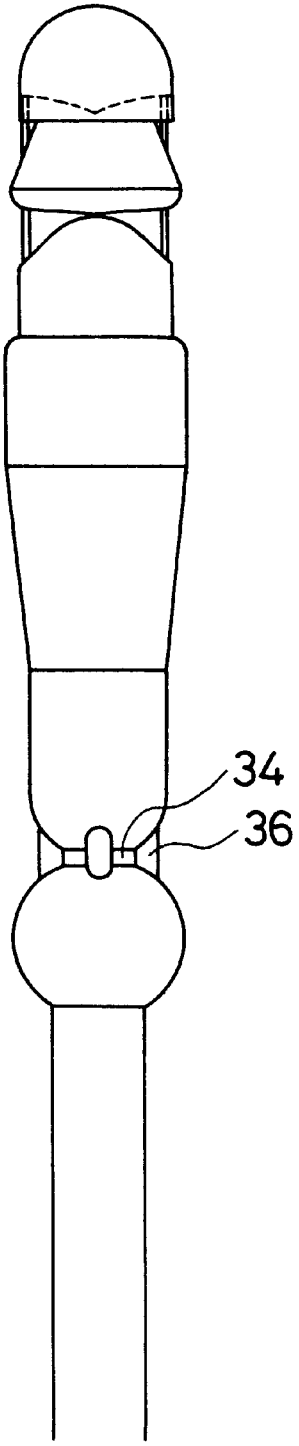
FIGS. 8A –8C shows a sixth embodiment of the sealing device of the present invention.
Figure 8C:
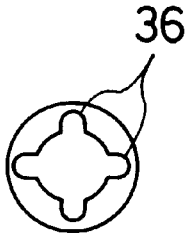
Figure 8A:
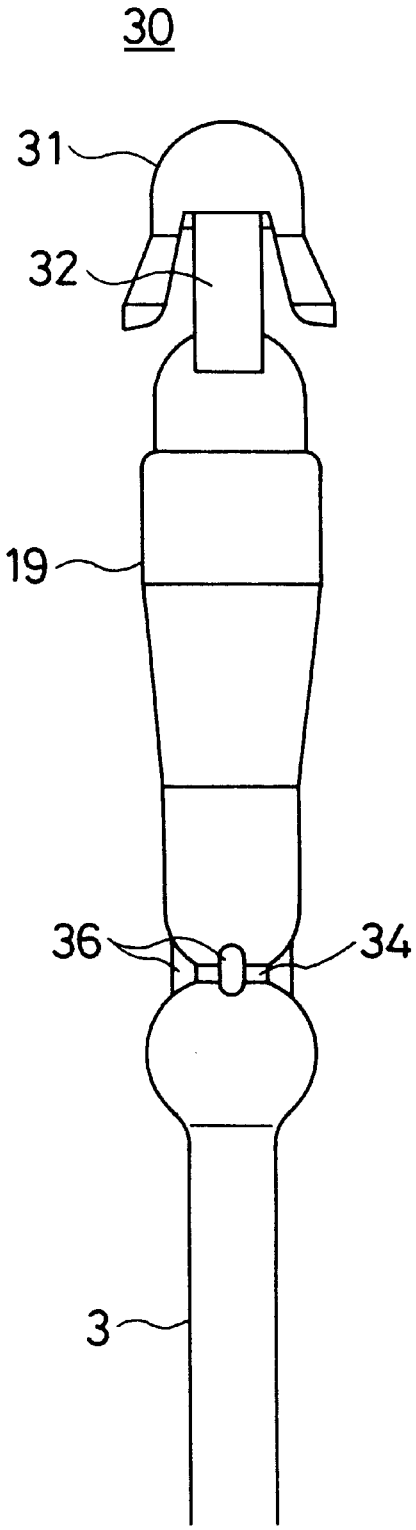

To attain this object of the present invention, for example, as shown in FIG. 8(A) and FIG. 8(B), at least one suitable lib portion 36 can be provided on the slit portion or the portion having the narrow diameter, as a reinforcement member.

As shown in FIG. 8(B), for example, a cross-sectional configuration of the ribbed portion 36 is preferably a cross configuration when seeing it from the direction of the push-through head portion 19.

In the resent invention, the configuration, height and its numbers there of can be optionally determined as a designing matter.

As explained above, the basic construction of the sealing device 30 of the present invention, for example, is such that a sealing device which comprises a filament portion, a push-through head portion provided at one of end portions of the filament portion and having a hooked portion, and a socket portion provided at another ends of the filament portion and having a hole through which the push-through head portion can pass in one direction but not be withdrawn in the opposite direction, and wherein the sealing device being constructed so that once when the push-through head portion had been inserted into the socket portion to seal, a predetermined portion of the push-through head portion is cut off with stretch force so as to be prevented the sealing device from being re-sealed, and the sealing device being further characterized in that the socket portion 2 being provided with a hole 10 through which the push-through head portion 19 can pass in one direction but not be withdrawn in the opposite direction and further inside of the hole 10, a contacting portion 16 to which the a portion of the sealing device can be contacted thereto is provided.

The sealing device of the present invention, the contacting portion 16 which is provided in the hole 10 of the socket portion 2, comprises a projecting portion or concaved portion formed inside the hole 10.

Further, the sealing device of the present invention, the push-through head portion 19 is further provided with at least one projecting portion 23 which can be contacted to the connecting portion 16, as provided in the hole 10 And more over, the push-through head portion 19 is further provided with at least one blade portion 23 having bias force directed to an external direction of the push-through head portion 19 so as to contact to the connecting portion 16.

In the present invention, a size of the socket portion 2 as used in the socket portion 30, is preferably set at a size so as to easily be picked up while having as mall external size. the sealing device 30 push-through head portion 19

Another preferred embodiment of the present invention, the push-through head portion 19 may bi provided with at least one ring like projected portion 40 having a diameter larger than that of the neighbouring portion P1 of the push-through head portion 19 and the ring like projected portion 40 is preferably formed there on perpendicular to the axis of the push-through head portion 19.

The ring like projected portion 40 can be formed integrated with the push-through head portion 19, when the push-through head portion 19 is formed.

And the number, a size or a configuration thereof is optional and thus, they can be formed depending upon a situation under which it will be used.

Figure 9:
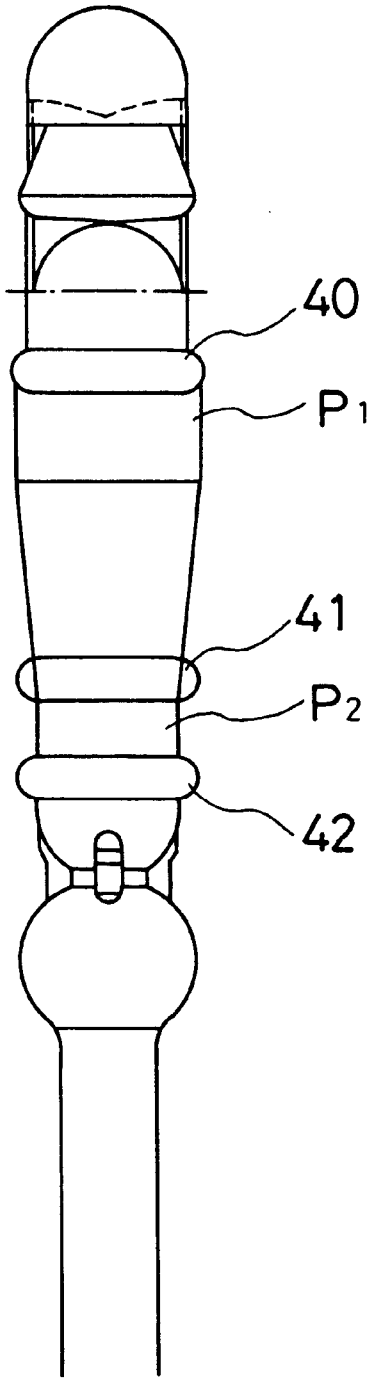
FIG. 9 shows a seventh embodiment of the sealing device of the present invention.

Therefore, as shown in FIG. 9, a first ring like projected portion 40 is formed at a portion P1 of the push-through head portion 19 that is closer to the blade portion 23 but separate ring like projected portion 40, that is a second and a third ring like projected portions 41 and 42 can be provided on a portion P2, which is closer to the weak portion 32.

In the present invention, the ring like projected portions 40 to 42 serve as a stopper portion or serve as a portion which makes it easy to be grasped by user thereof, when he will try to insert the push-through head portion 19 into the hole 10 of the socket portion 2.

In the present invention, since the push-through head portion 19 has the technical construction as mentioned above, a new sealing device which has not a capability of the push-through head portion being re-inserted into the socket portion 2 again with highly possibility thereof, can be provided.

Further, in the present invention, a new sealing device which can remain an evidence showing the fact that the sealed condition of the sealing device had been illegally broken when some one had broken the sealing condition of the sealing device, intentionally.

I claim:

1. A sealing device which comprises a filament portion, a push-through head portion provided at one of ends portion of said filament portion and having a suitable connecting portion, and a socket portion provided at another end of said filament portion and having a hole through which said push-through head portion can pass in one direction but not be withdrawn in the opposite direction, and wherein at least a portion of said push-through head portion is provided with a weak portion which can be easily cut off with a predetermined stretch force, and further wherein said weak portion thereof comprising a slit portion formed at least on one portion of said push-through head portion and formed in a direction perpendicular to an axis of said push-through head portion, a diameter of said slit portion being smaller than that of said push-through head portion, and a ribbed portion provided on a portion inside said slit portion.

2. A sealing device according to claim 1, wherein a cross-sectional configuration of said ribbed portion seeing along said axis of said push-through head portion, is a cross shaped configuration.

3. A sealing device according to claim 1, herein said push-through head portion is made of undrawn synthetic polymer resin.

4. A sealing device according to claim 1, wherein said filament portion is made of drawn synthetic polymer resin.

5. A sealing device according to claim 1 wherein, said push-through head portion is so constructed that it can be cut off when it is stretched with stretching force of 6 to 8 kg.

6. A sealing device according to claim 1 wherein, said socket portion has a size easily to be picked up while having a small external size.

7. A sealing device according to claim 1 wherein, said push-through head portion is provided with at least one ring-like projected portion having a diameter larger than that of a neighboring portion of said push-through head portion and perpendicular to the axis of said push-through head portion.

8. A sealing device according to claim 7 wherein, said ring like projected portion serves as any one of any stopper portion and a portion which makes it easy to be grasped by user thereof.

* * * * *